US008807555B2

(12) United States Patent
Tsai

(10) Patent No.: US 8,807,555 B2
(45) Date of Patent: Aug. 19, 2014

(54) AUTOMATIC DOCUMENT FEEDER

(71) Applicant: Primax Electronics Ltd., Neihu (TW)

(72) Inventor: Shang-Hsien Tsai, Neihu (TW)

(73) Assignee: Primax Electronics Ltd., Neihu (TW)

( * ) Notice: Subject to any disclaimer, the term of this patent is extended or adjusted under 35 U.S.C. 154(b) by 0 days.

(21) Appl. No.: 13/867,944

(22) Filed: Apr. 22, 2013

(65) Prior Publication Data

US 2014/0131937 A1 May 15, 2014

(30) Foreign Application Priority Data

Nov. 9, 2012 (TW) ..... 101141799 A

(51) Int. Cl.
*B65H 3/52* (2006.01)
*B65H 3/06* (2006.01)

(52) U.S. Cl.
CPC ..... *B65H 3/0684* (2013.01)
USPC ..... 271/122; 271/117; 271/118; 271/121

(58) Field of Classification Search
USPC ..... 271/117, 118, 122, 120, 121
See application file for complete search history.

(56) References Cited

U.S. PATENT DOCUMENTS

| | | | | |
|---|---|---|---|---|
| 6,792,241 | B2 * | 9/2004 | Nakagawa et al. | 399/367 |
| 7,651,082 | B2 * | 1/2010 | Hendrix et al. | 271/121 |
| 8,511,670 | B2 * | 8/2013 | Maeda | 271/110 |
| 2008/0054549 | A1 * | 3/2008 | Lee | 271/117 |

* cited by examiner

*Primary Examiner* — Michael McCullough
*Assistant Examiner* — Howard Sanders
(74) *Attorney, Agent, or Firm* — Kirton McConkie; Evan R. Witt

(57) ABSTRACT

An automatic document feeder includes an upper cover, a pick-up arm, a restriction element, and a document stopper. The pick-up arm is movable between a first position and a second position. A rotating shaft of the restriction element is pivotally coupled to the pick-up arm. A rotating shaft of the document stopper is pivotally coupled to the upper cover. Moreover, the rotating shaft of the restriction element and the rotating shaft of the document stopper are not in parallel with each other. When the pick-up arm is located at the first position, a swinging action of the document stopper is limited by the restriction element. When the pick-up arm is located at the second position, the swinging action of the document stopper is no longer limited by the restriction element, so that the document stopper can be freely swung.

9 Claims, 17 Drawing Sheets

AUTOMATIC DOCUMENT FEEDER

FIELD OF THE INVENTION

The present invention relates to an automatic document feeder, and more particularly to an automatic document feeder with a document stopper.

BACKGROUND OF THE INVENTION

Nowadays, with the maturity of automatic feeding technologies, automatic document feeders (ADF) are widely used in scanners, printers or any other office machines. By the automatic document feeders, many documents are automatically and successively fed into these office machines in order to achieve the labor-saving purpose. In a case where the automatic document feeder is an idle state (e.g. before the documents are fed into the office machine), the documents are stopped at a position in front of an entrance of a transfer channel by a document stopper of the automatic document feeder. Consequently, the documents are stopped from being introduced into the transfer channel.

Please refer to FIGS. 1~4. FIG. 1 is a schematic side view illustrating the structure of a conventional automatic document feeder, wherein the automatic document feeder is in an idle state. FIG. 2 is a schematic partial perspective view illustrating some components of the conventional automatic document feeder of FIG. 1 and taken along another viewpoint. FIG. 3 is a schematic side view illustrating the structure of the conventional automatic document feeder of FIG. 1, wherein the automatic document feeder is in a working state. FIG. 4 is a schematic partial perspective view illustrating some components of the conventional automatic document feeder of FIG. 3 and taken along another viewpoint.

The automatic document feeder 1 comprises an upper cover (not shown), an input tray 11, a transfer channel 12, a pick-up arm 13, a driving shaft 14, a restriction element 15, and a document stopper 16. The pick-up arm 13 is located near an entrance of the transfer channel 12. The driving shaft 14 is penetrated through the pick-up arm 13, and pivotally coupled to the upper cover. When the driving shaft 14 is driven by a motive power source (not shown) to be rotated, the pick-up arm 13 is correspondingly moved from a first position X1 (see FIG. 1) to a second position X2 (see FIG. 3) or moved from the second position X2 to the first position X1. Moreover, the pick-up arm 13 comprises a pick-up roller 131 and a separation roller 132. When the automatic document feeder 1 is in the working state, the pick-up arm 13 is moved to the second position X2. Consequently, the uppermost document P11 on the input tray 11 is picked up by the pick-up roller 131 to be fed into the transfer channel 12. The separation roller 132 is used for separating the uppermost document P11 and the underlying document P12 on the input tray 11 from each other, thereby preventing multiple documents P1 from being simultaneously fed into the transfer channel 12.

Moreover, the document stopper 16 comprises a rotating shaft 161, a sustaining part 162, and a stopping part 163. The rotating shaft 161 is penetrated through the region between the sustaining part 162 and the stopping part 163, and pivotally coupled to the upper cover. The restriction element 15 is fixed on a sidewall of the pick-up arm 13. When the automatic document feeder 1 is in the idle state, the pick-up arm 13 is moved to the first position X1. Under this circumstance, the stopping part 163 of the document stopper 16 is arranged between the documents P1 and the entrance of the transfer channel 12. In addition, since the sustaining part 162 of the document stopper 16 is contacted with the restriction element 15, the swinging action of the document stopper 16 relative to the rotating shaft 161 will be limited by the restriction element 15. At this moment, the range of allowing the document P11 on the input tray 11 to swing the document stopper 16 in the direction D1 is limited to a very small extent. Consequently, the documents P1 are stopped from being introduced into the transfer channel 12.

When the automatic document feeder 1 is in the working state, the pick-up arm 13 should be moved to the second position X2. As the pick-up arm 13 is moved, the restriction element 15 is correspondingly moved in a direction away from the sustaining part 162 of the document stopper 16. Under this circumstance, the sustaining part 162 of the document stopper 16 is no longer limited by the restriction element 15, and thus the sustaining part 162 of the document stopper 16 can be freely swung relative to the rotating shaft 161. Meanwhile, the document P11 which is disposed on the input tray 11 and moved forwardly by the pick-up roller 131 can easily push the stopping part 163 of the document stopper 16. Consequently, the document stopper 16 is swung in the direction D1 and conveniently introduced into the transfer channel 12. After the document P11 is completely introduced into the transfer channel 12, since the stopping part 163 of the document stopper 16 is no longer pushed by the document P11, the document stopper 16 is swung to its original position in the direction D2 in response to the gravity force.

However, in some situations, the automatic document feeder 1 still has some drawbacks. For example, in a first situation, after the document feeding task is ended, the pick-up arm 13 of the automatic document feeder 1 is ascended from the second position X2 to the first position X1. In a second situation, during the document P11 is fed into the transfer channel 12, the pick-up arm 13 should be temporarily ascended from the second position X2 to the first position X1 in order to achieve the maximum functions of the automatic document feeder 1 with the minimum motive power source. Under these situations, if the document P11 is not stayed at the original position where the automatic document feeder 1 is in the idle state, the pick-up arm 13 of the conventional automatic document feeder 1 may fail to be moved from the second position X2 to the first position X1 because the pick-up arm 13 is influenced by the document stopper 16. If the pick-up arm 13 is reluctantly driven to be moved from the second position X2 to the first position X1, the possibility of causing damage of the document P11 is increased.

Please refer to FIGS. 5 and 6. FIG. 5 is a schematic side view illustrating the conventional automatic document feeder of FIG. 1 during the pick-up arm is ascended from the second position to the first position, in which the document is not stayed at the original position where the automatic document feeder is in the idle state. FIG. 6 is a schematic partial perspective view illustrating some components of the conventional automatic document feeder of FIG. 5 and taken along another viewpoint.

As shown in FIGS. 5 and 6, during the pick-up arm 13 of the conventional automatic document feeder 1 is ascended from the second position X2 to the first position X1, the document P11 is stayed at a position higher than its original position X4 where the automatic document feeder 1 is in the idle state. Meanwhile, since the stopping part 163 of the document stopper 16 is contacted with the front end of the document P11, the document stopper 16 fails to be swung to its original position in response to the gravity force. Under this circumstance, when the pick-up arm 13 is ascended in the direction toward the first position X1 to a third position X3, which is arranged between the first position X1 and the second position X2, the sustaining part 162 of the document stopper 16 is contacted with the restriction element 15. Consequently, the pick-up arm 13 fails to be continuously ascended. If the pick-up arm 13 is reluctantly driven to be ascended, the restriction element 15 is conveniently forced to push the sustaining part 162 of the document stopper 16, so that the document stopper 16 is swung in the direction D2. Under this circumstance, since the front end of the document P11 is pushed by the stopping part 163 of the document stopper 16, the document P11 is possibly damaged.

Moreover, during the pick-up arm 13 of the conventional automatic document feeder 1 is moved from the first position X1 to the second position X2, if the stopping part 163 of the document stopper 16 is excessively pushed by the document P11, the movement of the pick-up arm 13 is hindered. FIG. 7 is a schematic side view illustrating the conventional automatic document feeder of FIG. 1, in which the stopping part of the document stopper is excessively pushed by the document and the movement of the pick-up arm is hindered. As shown in FIG. 7, since the stopping part 163 of the document stopper 16 is excessively pushed by the front end of the document P11, the sustaining part 162 of the document stopper 16 is contacted with the restriction element 15. Consequently, a force F1 is applied to the region between the sustaining part 162 and the restriction element 15. Meanwhile, the magnitude of the torque for the force F1 to rotate the driving shaft 14 is equal to F1×R1, wherein R1 is a vertical distance of the force F1 from an axel center of the driving shaft 14. In other words, for driving the movement of the pick-up arm 13 from the first position X1 to the second position X2, the rotation of the driving shaft 14 should surmount the torque F1×R1.

Therefore, there is a need of providing an improved automatic document feeder in order to eliminate the above drawbacks.

SUMMARY OF THE INVENTION

The present invention provides an automatic document feeder with a document stopper, in which a pick-up arm of the automatic document feeder can be smoothly operated.

In accordance with an aspect of the present invention, there is provided an automatic document feeder. The automatic document feeder includes an upper cover, a transfer channel, a pick-up arm, a restriction element, and a document stopper. The pick-up arm is located near an entrance of the transfer channel, and reciprocally movable between a first position and a second position. The restriction element includes a first rotating shaft. The first rotating shaft is pivotally coupled to the pick-up arm. The document stopper includes a second rotating shaft. The second rotating shaft is pivotally coupled to the upper cover, and the second rotating shaft is not in parallel with the first rotating shaft. When the pick-up arm is located at the first position, the restriction element is contacted with the document stopper, so that a swinging action of the document stopper is limited by the restriction element. When the pick-up arm is located at the second position, the restriction element is separated from the document stopper, so that the document stopper is permitted to be freely swung.

In an embodiment, the first rotating shaft is disposed on a sidewall of the pick-up arm.

In an embodiment, the restriction element further includes a front part to be contacted with the document stopper and a rear part. The first rotating shaft is penetrated through a region between the front part and the rear part. The pick-up arm further includes a blocking part. The blocking part is disposed on the sidewall of the pick-up arm for limiting a rotatable range of the rear part of the restriction element. Moreover, a weight of the rear part is larger than the front part.

In an embodiment, the restriction element further includes a torsion spring, and the torsion spring is sheathed around the first rotating shaft.

In an embodiment, the document stopper further includes a sustaining part and a stopping part. When the pick-up arm is located at the first position, the sustaining part is contacted with the restriction element, and a document is stopped by the stopping part from being introduced into the transfer channel.

In an embodiment, the automatic document feeder further includes a driving shaft. The driving shaft is penetrated through the pick-up arm, and pivotally coupled to the upper cover.

In an embodiment, the relative positions between the restriction element, the document stopper and the driving shaft are determined according to a direction of a pushing force which is applied to the restriction element by the document stopper. An extension line of the direction of the pushing force which is applied to the restriction element by the document stopper intersects an axel center of the driving shaft.

In an embodiment, the pick-up arm includes a pick-up roller and a separation roller. The pick-up roller is used for feeding a first document of plural documents into the transfer channel. The separation roller is used for separating the first document from a second document underlying the first document, so that only the first document is allowed to be fed into the transfer channel.

In an embodiment, the automatic document feeder further includes an input tray for supporting at least one document thereon.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
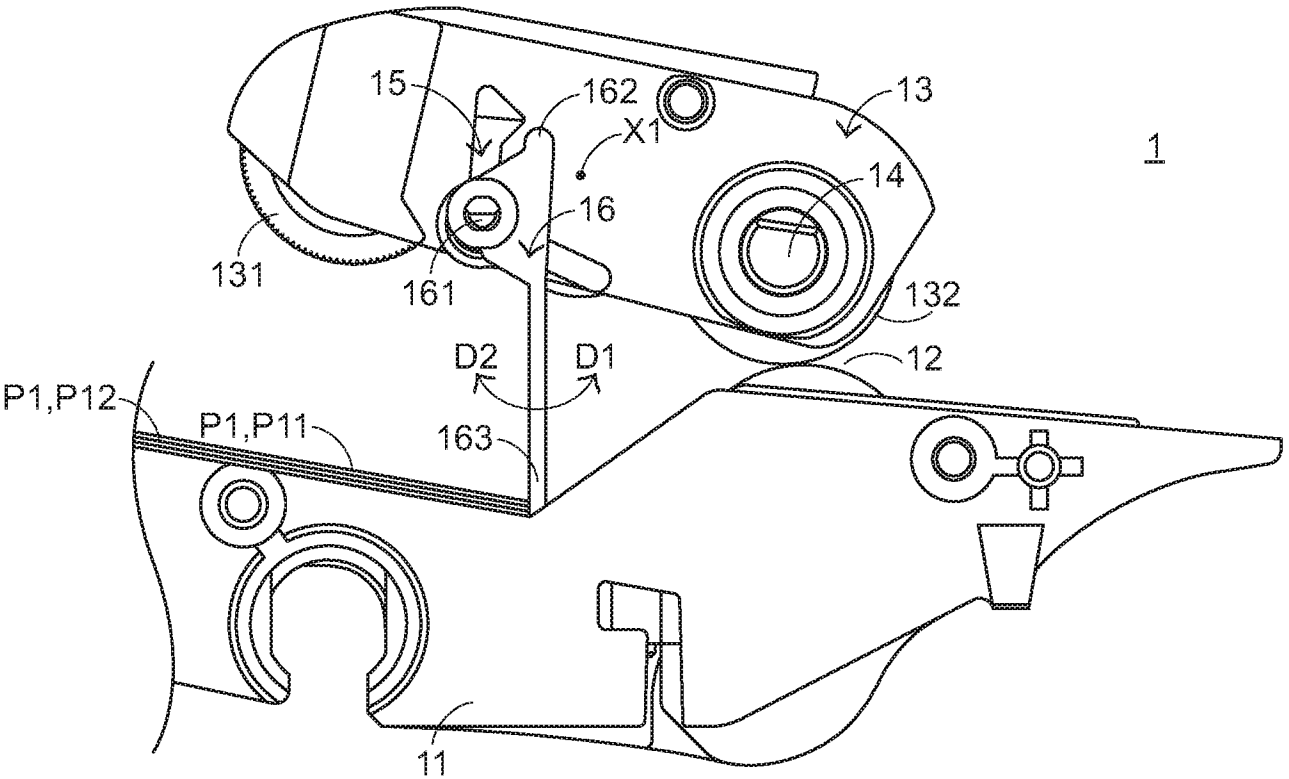
FIG. 1 PRIOR ART
FIG. 1 is a schematic side view illustrating the structure of a conventional automatic document feeder, wherein the automatic document feeder is in an idle state.
Figure 2:
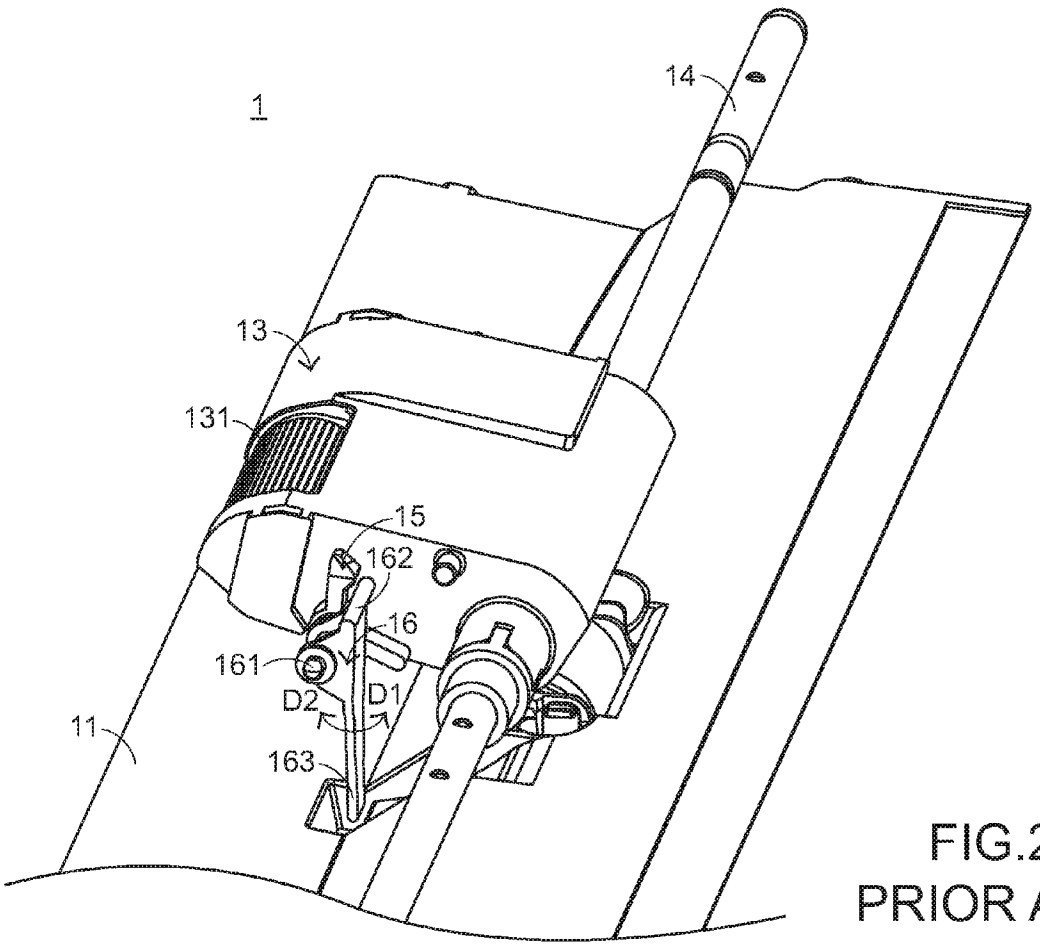
FIG.2 PRIOR ART
FIG. 2 is a schematic partial perspective view illustrating some components of the conventional automatic document feeder of FIG. 1 and taken along another viewpoint.
Figure 3:
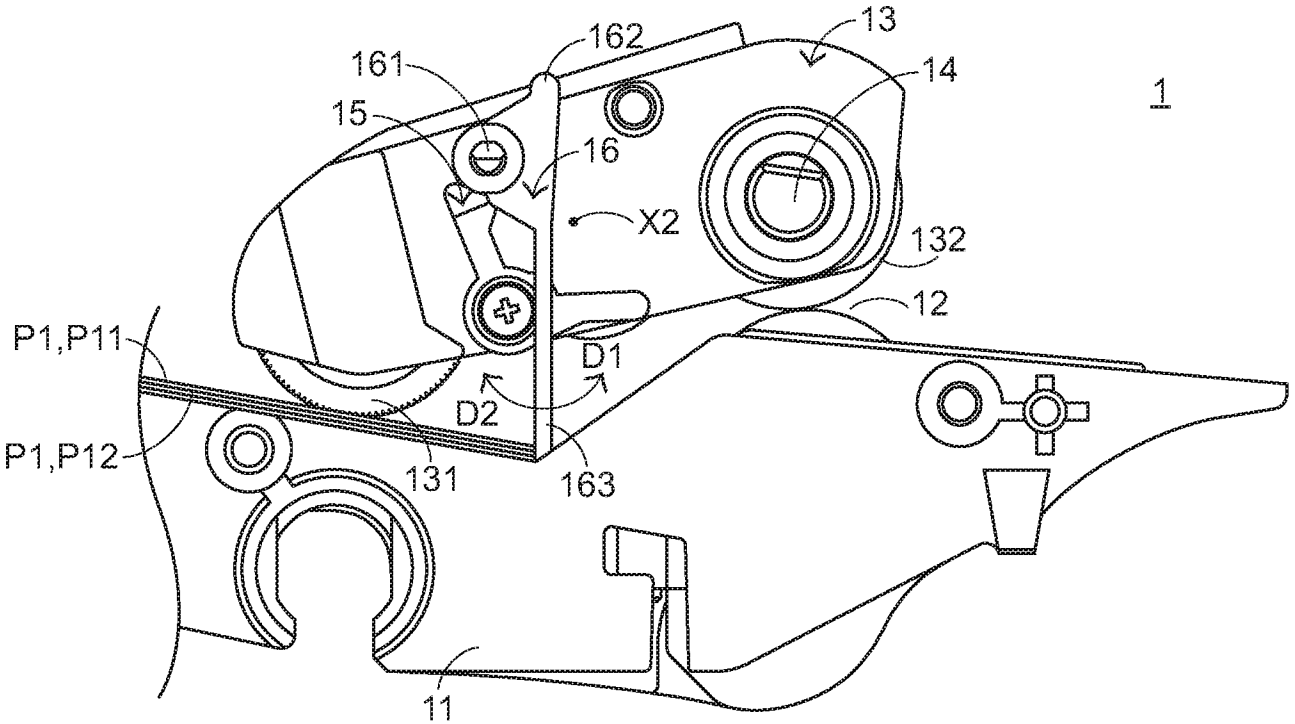
FIG.3 PRIOR ART
FIG. 3 is a schematic side view illustrating the structure of the conventional automatic document feeder of FIG. 1, wherein the automatic document feeder is in a working state.
Figure 4:
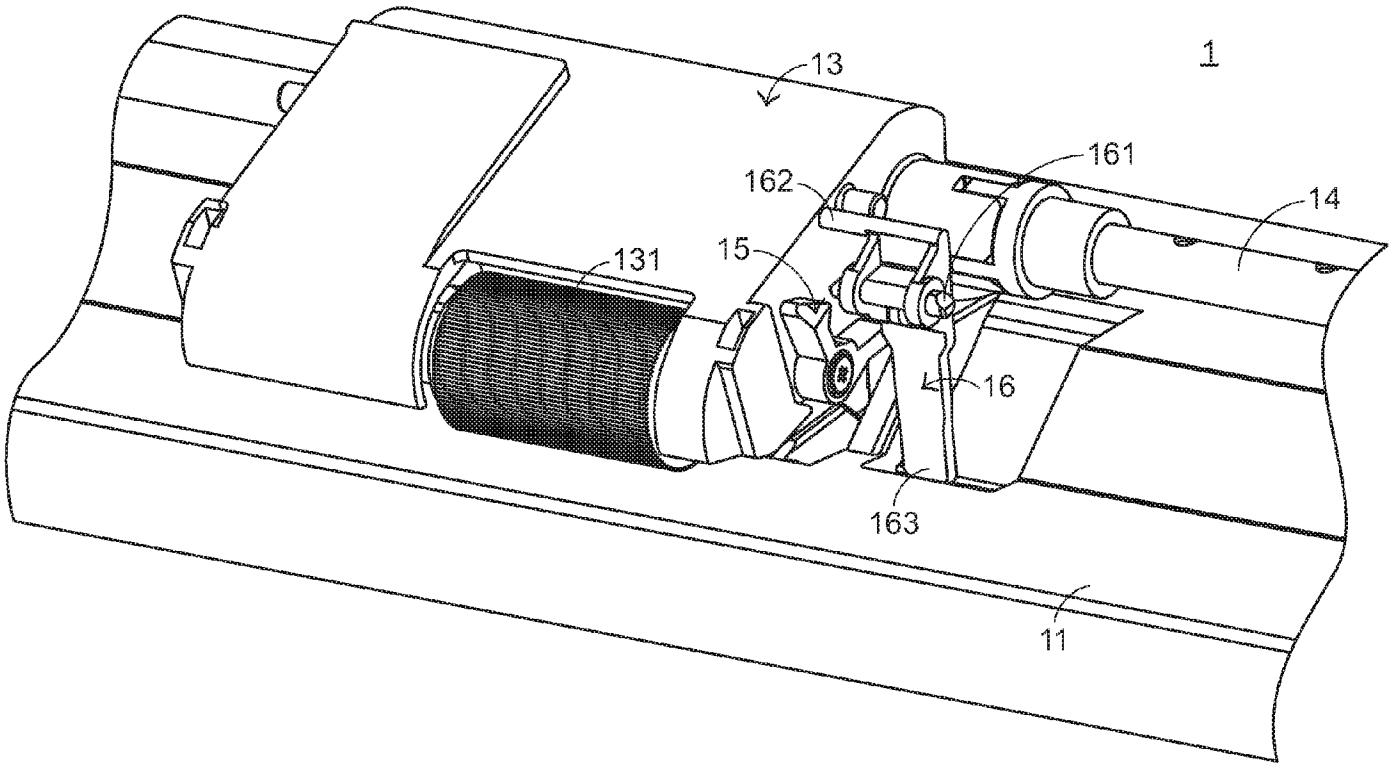
FIG.4 PRIOR ART
FIG. 4 is a schematic partial perspective view illustrating some components of the conventional automatic document feeder of FIG. 3 and taken along another viewpoint.
Figure 5:
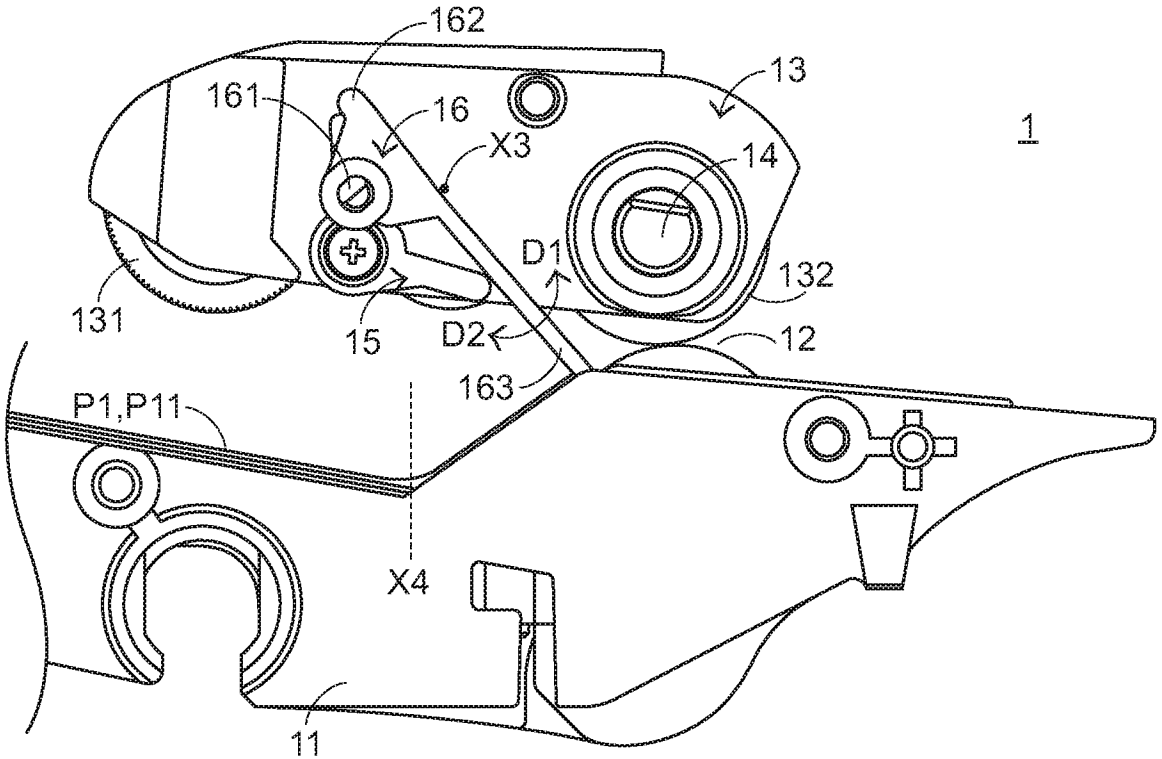
FIG.5 PRIOR ART
FIG. 5 is a schematic side view illustrating the conventional automatic document feeder of FIG. 1 during the pick-up arm is ascended from the second position to the first position, in which the document is not stayed at the original position where the automatic document feeder is in the idle state.
Figure 6:
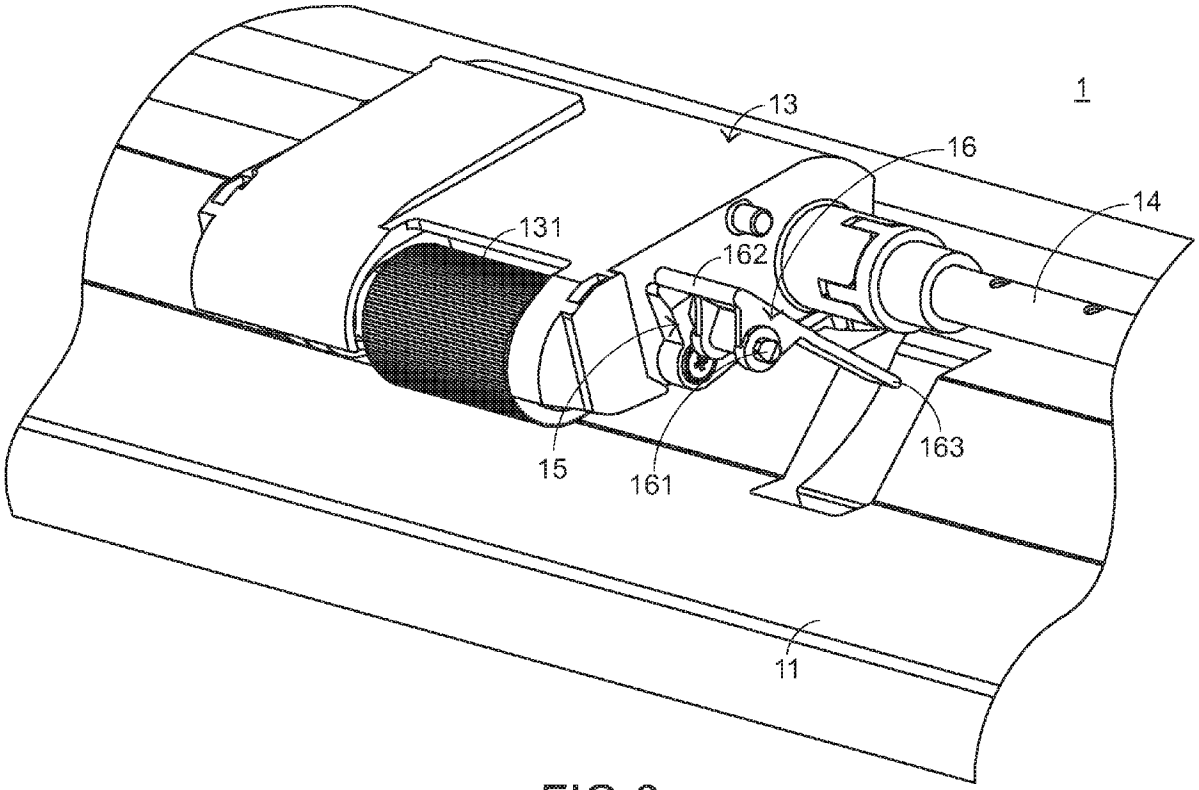
FIG.6 PRIOR ART
FIG. 6 is a schematic partial perspective view illustrating some components of the conventional automatic document feeder of FIG. 5 and taken along another viewpoint.
Figure 7:
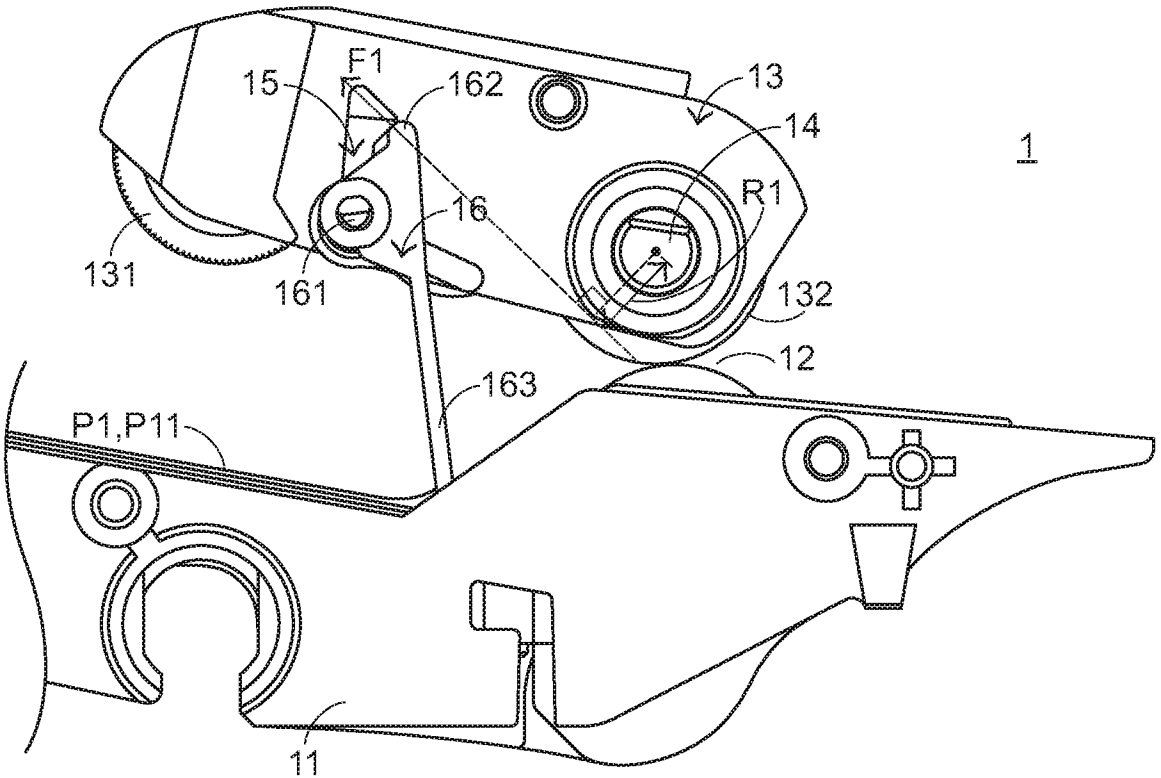
FIG.7 PRIOR ART
FIG. 7 is a schematic side view illustrating the conventional automatic document feeder of FIG. 1, in which the stopping part of the document stopper is excessively pushed by the document and the movement of the pick-up arm is hindered.
Figure 8:
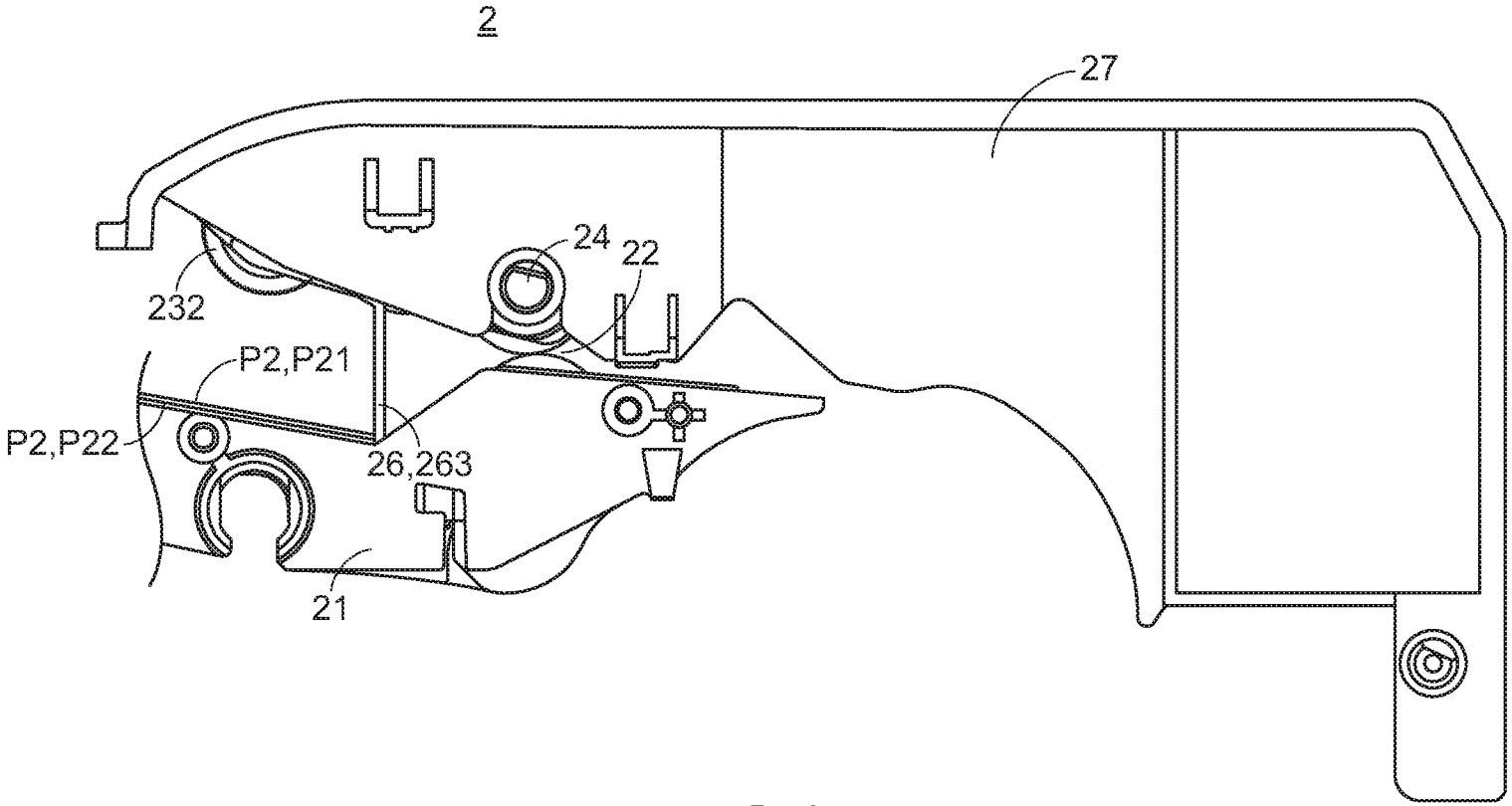
FIG. 8 is a schematic side view illustrating the outward structure of an automatic document feeder according to an embodiment of the present invention.
Figure 9:
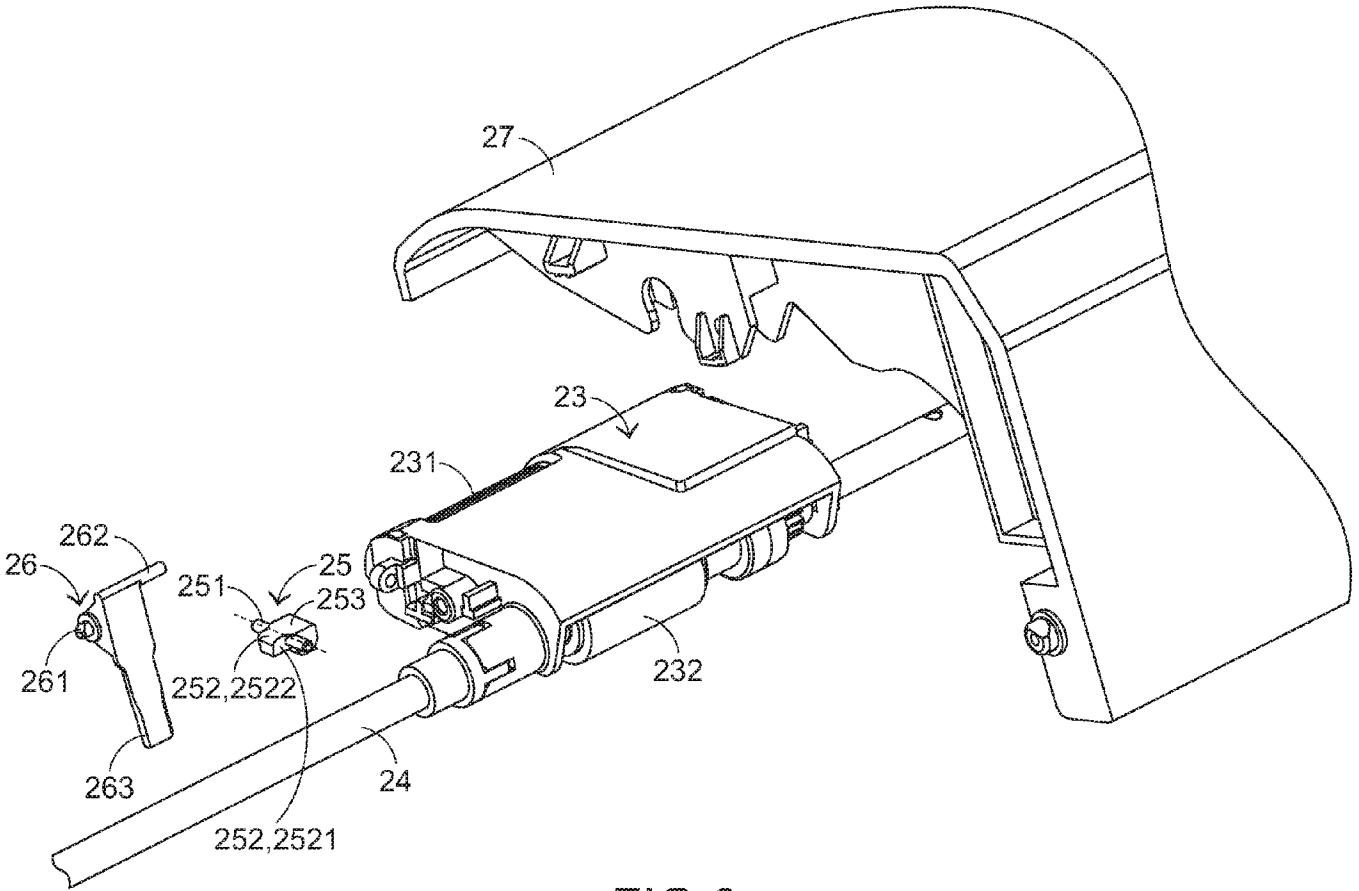
FIG. 9 is a schematic exploded view illustrating some components of the automatic document feeder of FIG. 8.
Figure 10:
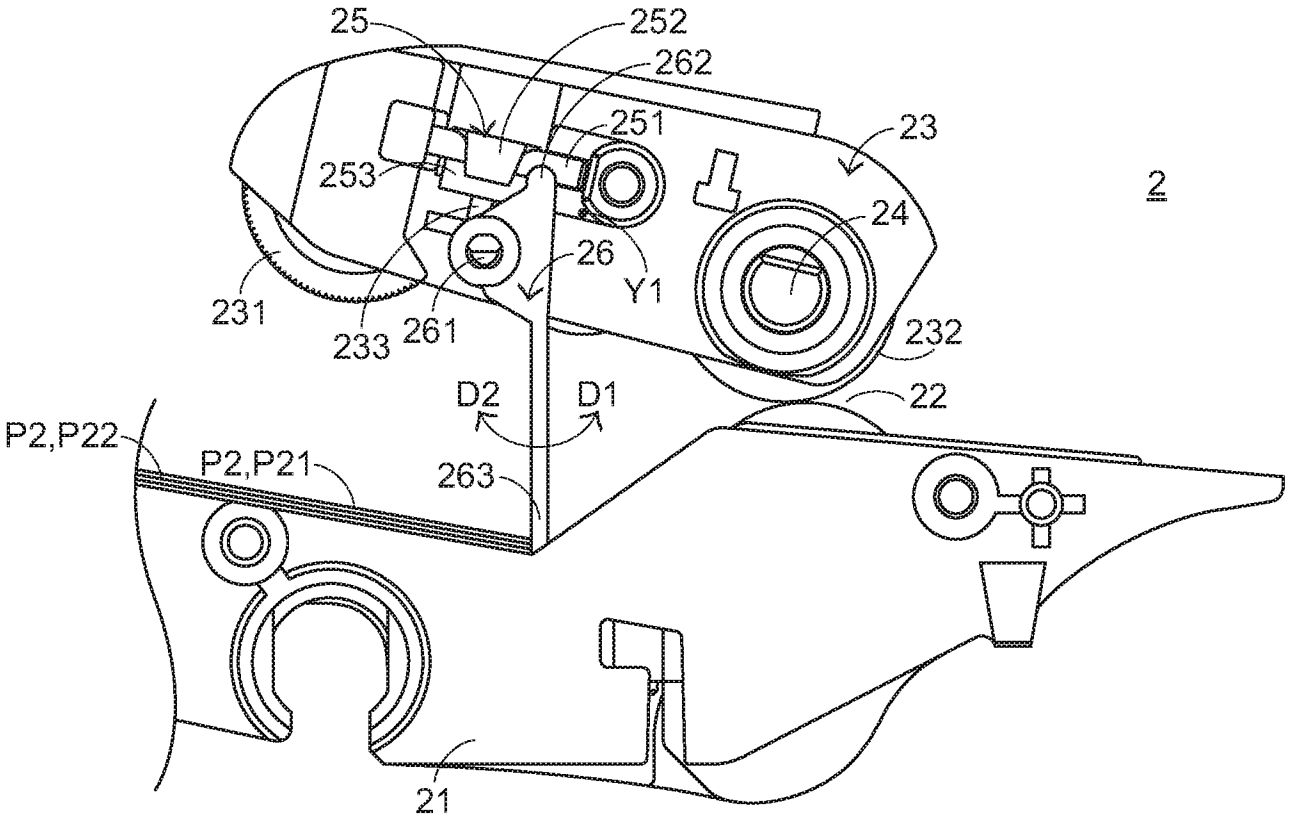
FIG. 10 is a schematic side view illustrating the automatic document feeder of FIG. 8 in an idle state.
Figure 11:
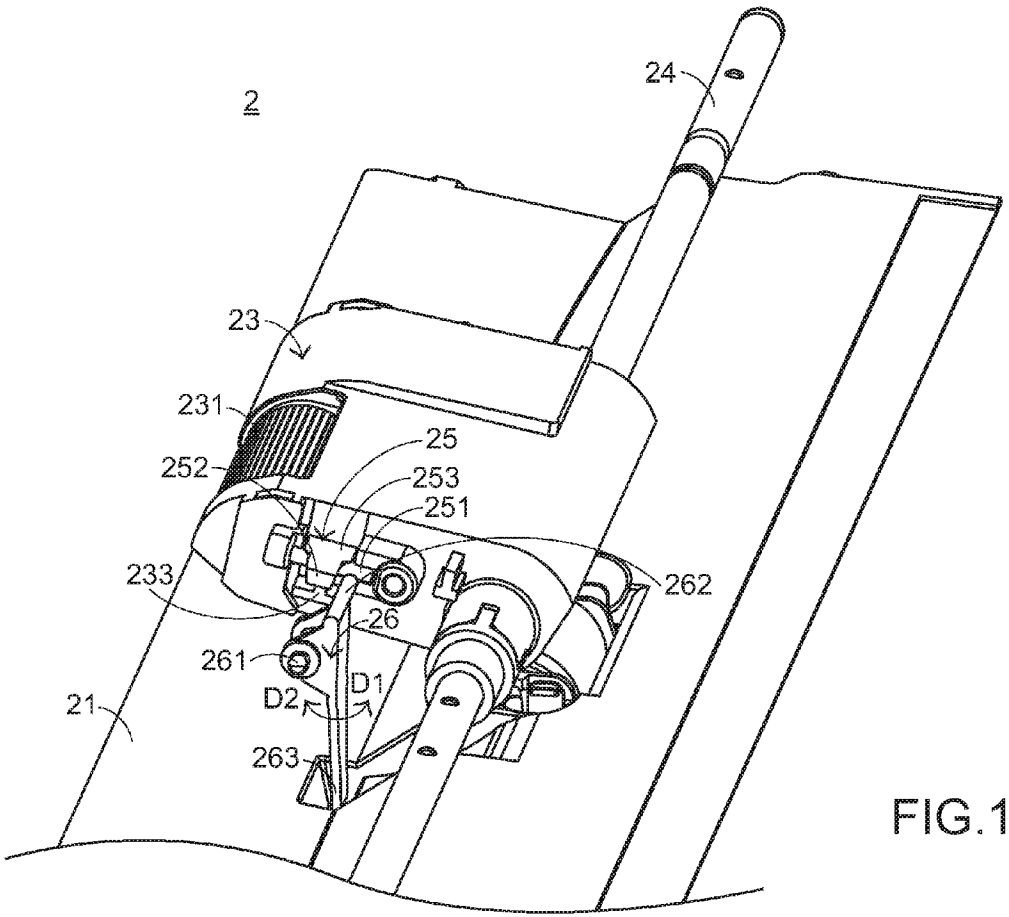
FIG. 11 is a schematic partial perspective view illustrating some components of the automatic document feeder of FIG. 10 and taken along another viewpoint.
Figure 12:
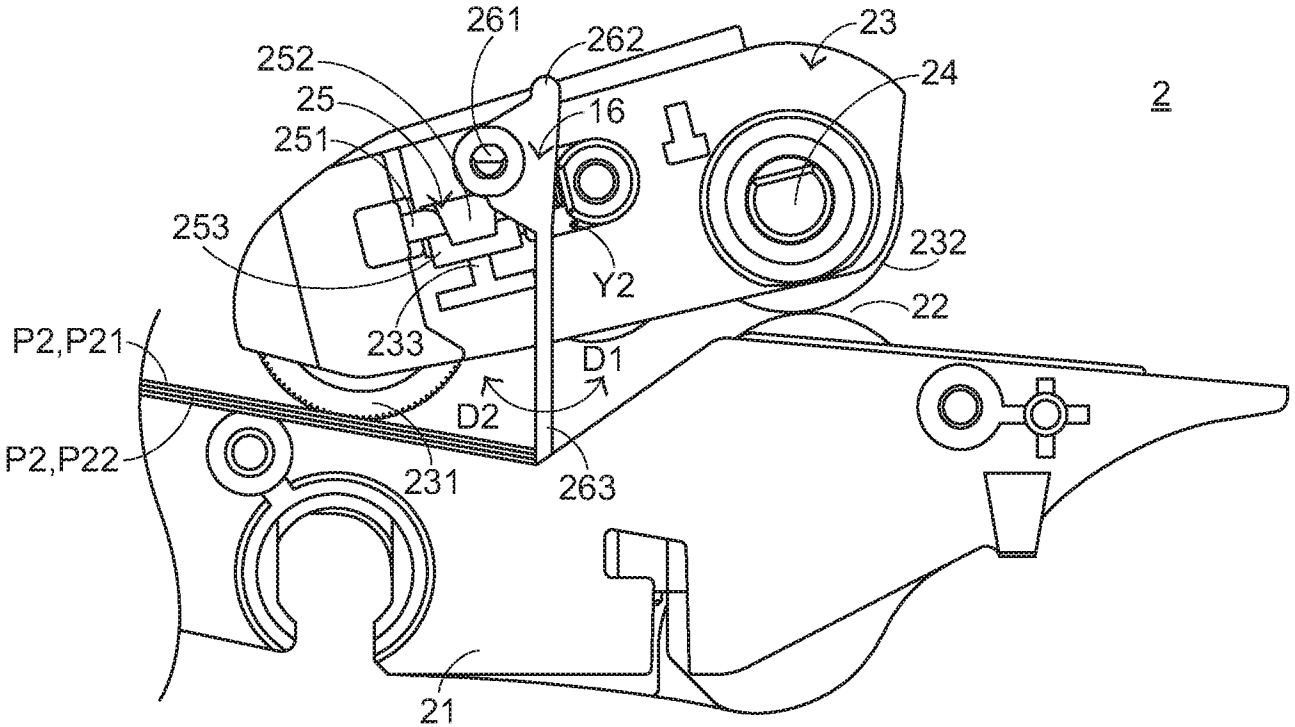
FIG. 12 is a schematic side view illustrating the automatic document feeder of FIG. 8 in a working state.
Figure 13:
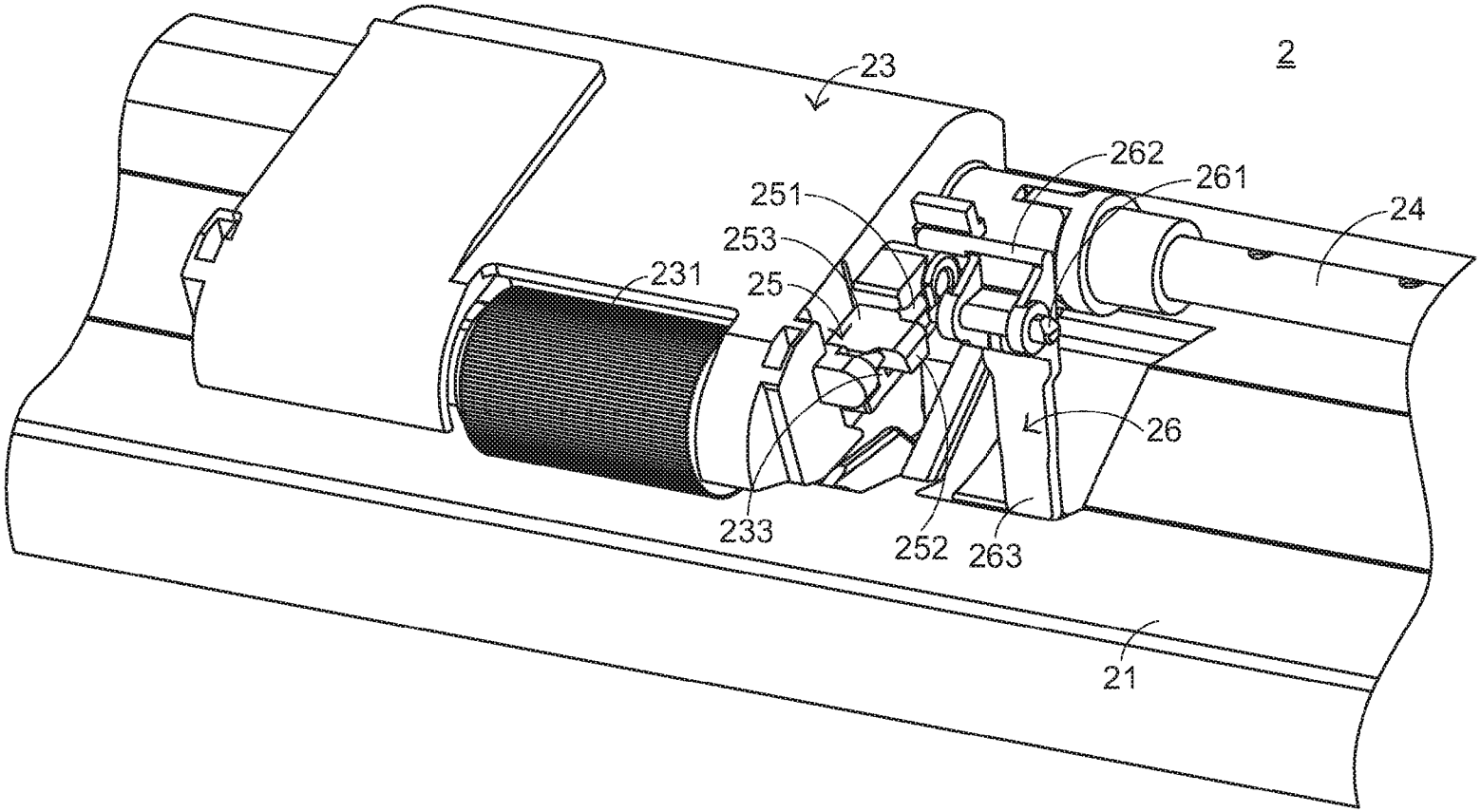
FIG. 13 is a schematic partial perspective view illustrating some components of the automatic document feeder of FIG. 12 and taken along another viewpoint.

Please refer to FIGS. 8~13. FIG. 8 is a schematic side view illustrating the outward structure of an automatic document feeder according to an embodiment of the present invention. FIG. 9 is a schematic exploded view illustrating some components of the automatic document feeder of FIG. 8. FIG. 10 is a schematic side view illustrating the automatic document feeder of FIG. 8 in an idle state. FIG. 11 is a schematic partial perspective view illustrating some components of the automatic document feeder of FIG. 10 and taken along another viewpoint. FIG. 12 is a schematic side view illustrating the automatic document feeder of FIG. 8 in a working state. FIG. 13 is a schematic partial perspective view illustrating some components of the automatic document feeder of FIG. 12 and taken along another viewpoint.

The automatic document feeder 2 comprises an upper cover 27, an input tray 21, a transfer channel 22, a pick-up arm 23, a driving shaft 24, a restriction element 25, and a document stopper 26. The pick-up arm 23 is located near an entrance of the transfer channel 22. The driving shaft 24 is penetrated through the pick-up arm 23, and pivotally coupled to the upper cover 27. When the driving shaft 24 is driven by a motive power source (not shown) to be rotated, the pick-up arm 23 is correspondingly moved from a first position Y1 (see FIG. 10) to a second position Y2 (see FIG. 12) or moved from the second position Y2 to the first position Y1.

Moreover, the pick-up arm 23 comprises a pick-up roller 231 and a separation roller 232. When the automatic document feeder 2 is in the working state, the pick-up arm 23 is moved to the second position Y2. Consequently, the uppermost document P21 on the input tray 21 is picked up by the pick-up roller 231 to be fed into the transfer channel 22. The separation roller 232 is used for separating the uppermost document P21 and the underlying document P22 on the input tray 21 from each other, thereby preventing multiple documents P2 from being simultaneously fed into the transfer channel 22.

Moreover, the restriction element 25 comprises a first rotating shaft 251, a front part 252, and a rear part 253. The first rotating shaft 251 of the restriction element 25 is penetrated through the region between the front part 252 and the rear part 253, and pivotally coupled to a sidewall of the pick-up arm 23. The document stopper 26 comprises a second rotating shaft 261, a sustaining part 262, and a stopping part 263. The second rotating shaft 261 of the document stopper 26 is penetrated through the region between the sustaining part 262 and the stopping part 263, and pivotally coupled to the upper cover 27. In this embodiment, the first rotating shaft 251 and the second rotating shaft 261 are staggered. That is, the first rotating shaft 251 and the second rotating shaft 261 are not in parallel with each other.

When the automatic document feeder 2 is in the idle state, the pick-up arm 23 is located at the first position Y1. Under this circumstance, the stopping part 263 of the document stopper 26 is arranged between the documents P21 and the entrance of the transfer channel 22. Meanwhile, a lateral surface 2521 of the front part 252 of the restriction element 25 (see FIG. 9) is separated from the sustaining part 262 of the document stopper 26 by a tiny preset distance (or a zero distance). In addition, since the lateral surface 2521 of the front part 252 of the restriction element 25 is contacted with the sustaining part 262 of the document stopper 26, the swinging action of the document stopper 26 relative to the second rotating shaft 261 is limited. That is, the range of allowing the document P21 on the input tray 21 to swing the document stopper 26 in the direction D1 is limited to a very small extent. Consequently, the document P21 is stopped from being introduced into the transfer channel 22.

When the automatic document feeder 2 is in the working state, the pick-up arm 23 is moved to the second position Y2. As the pick-up arm 23 is moved, the restriction element 25 which is pivotally coupled to the pick-up arm 23 is synchronously moved with the pick-up arm 23. Consequently, the front part 252 of the restriction element 25 is moved away from the sustaining part 262 of the document stopper 26. Under this circumstance, the sustaining part 262 of the document stopper 26 is no longer limited by the restriction element 25, and thus the sustaining part 262 of the document stopper 26 can be freely swung relative to the second rotating shaft 261. Meanwhile, the document P21 which is disposed on the input tray 21 and moved forwardly by the pick-up roller 231 can easily push the stopping part 263 of the document stopper 26. Consequently, the document stopper 26 is swung in the direction D1 and conveniently introduced into the transfer channel 22. After the document P21 is completely introduced into the transfer channel 22, since the stopping part 263 of the document stopper 26 is no longer pushed by the document P21, the document stopper 26 is swung to the original position in the direction D2 in response to the gravity force.

Figure 14:
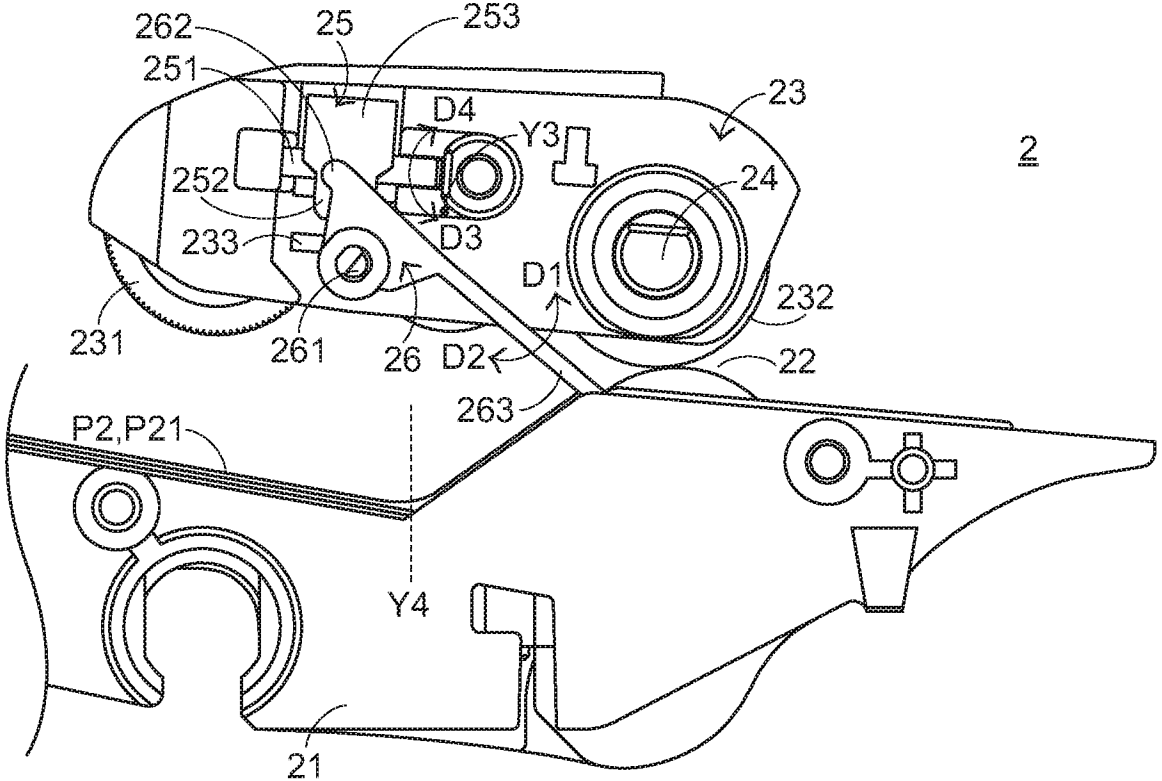
FIG. 14 is a schematic side view illustrating the automatic document feeder of FIG. 8 during the pick-up arm is ascended from the second position to the first position, in which the document is not stayed at the original position where the automatic document feeder is in the idle state.
Figure 15:
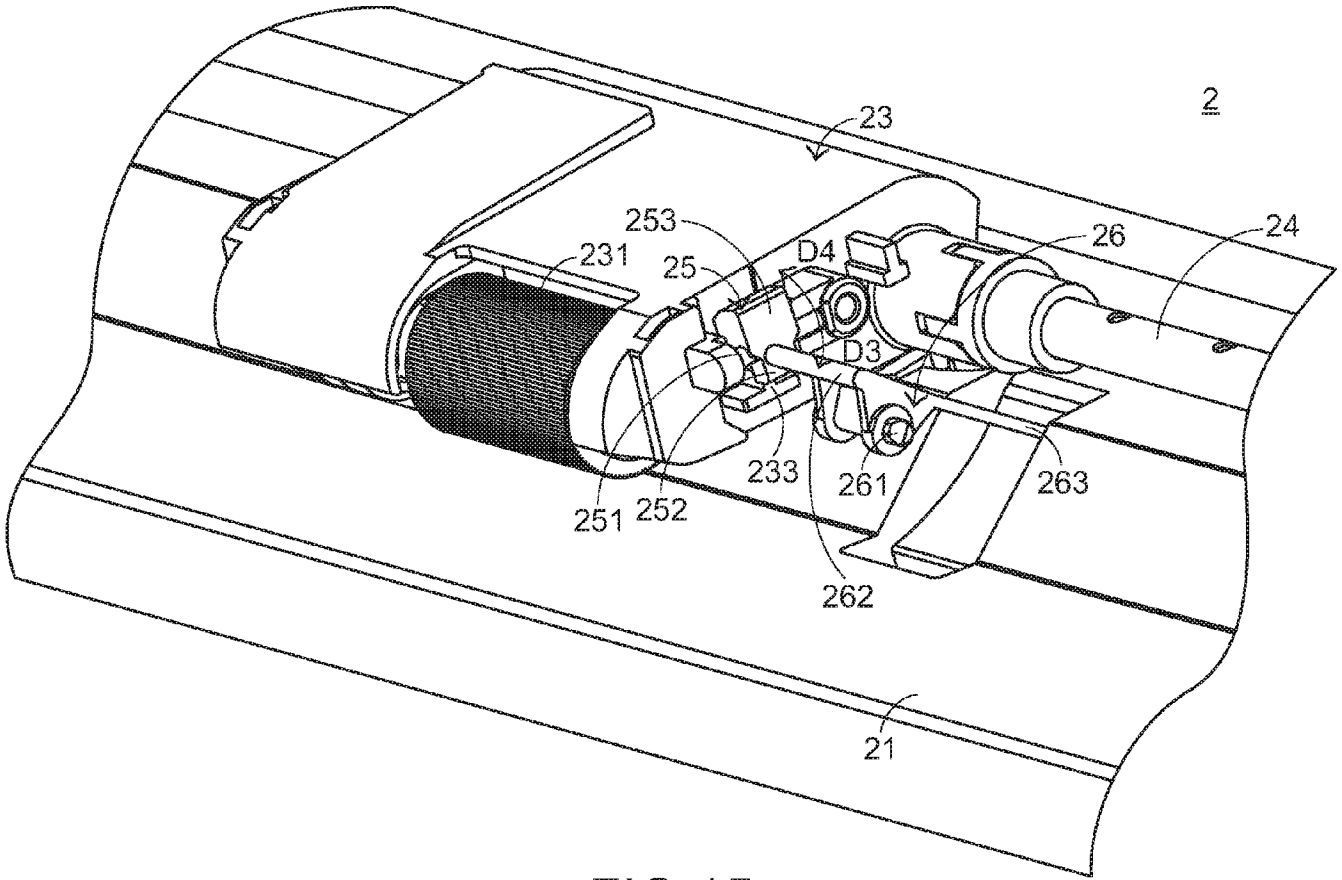
FIG. 15 is a schematic partial perspective view illustrating some components of the automatic document feeder of FIG. 14 and taken along another viewpoint.

Please refer to FIGS. 14 and 15. FIG. 14 is a schematic side view illustrating the automatic document feeder of FIG. 8 during the pick-up arm is ascended from the second position to the first position, in which the document is not stayed at the original position where the automatic document feeder is in the idle state. FIG. 15 is a schematic partial perspective view illustrating some components of the automatic document feeder of FIG. 14 and taken along another viewpoint.

As shown in FIGS. 14 and 15, during the pick-up arm 23 of the automatic document feeder 2 is ascended from the second position Y2 to the first position Y1, the document P21 is stayed at a position higher than its original position Y4 where the automatic document feeder 2 is in the idle state. Meanwhile, since the stopping part 263 of the document stopper 26 is contacted with the front end of the document P21, the document stopper 26 fails to be swung to its original position in response to the gravity force. Under this circumstance, when the pick-up arm 23 is ascended in the direction toward the first position Y1 to a third position Y3, which is arranged between the first position Y1 and the second position Y2, a top surface 2522 of the front part 252 of the restriction element 25 (see FIG. 9) is contacted with the sustaining part 262 of the document stopper 26. During the pick-up arm 23 is continuously ascended from the third position Y3 in the direction toward the first position Y1, since the top surface 2522 of the front part 252 of the restriction element 25 is pushed by the sustaining part 262 of the document stopper 26, the restriction element 25 is conveniently rotated in the direction D3 relative to the first rotating shaft 251. Under this circumstance, since the pick-up arm 23 is no longer hindered, the pick-up arm 23 can be smoothly moved to the first position Y1.

Please refer to FIG. 9 again. It is preferred that the weight of the rear part 253 of the restriction element 25 is larger than the front part 252 of the restriction element 25. Moreover, the pick-up arm 23 further comprises a blocking part 233. The blocking part 233 is disposed on the sidewall of the pick-up arm 23, and located at position along a rotation path of the rear part 253 of the restriction element 25. Please refer to FIGS. 14 and 15 again. As the restriction element 25 is conveniently rotated in the direction D3 relative to the first rotating shaft 251, the pick-up arm 23 can be smoothly ascended without difficulty. Under this circumstance, since the top surface 2522 of the front part 252 of the restriction element 25 is no longer contacted with the sustaining part 262 of the document stopper 26, the restriction element 25 is rotated in the direction D4 relative to the first rotating shaft 251. Moreover, since the blocking part 233 is located at a position along the rotation path of the rear part 253 of the restriction element 25, the rotatable range of the restriction element 25 is limited by the blocking part 233. That is, the restriction element 25 is continuously rotated in the direction D4 relative to the first rotating shaft 251 until the rear part 253 of the restriction element 25 is stopped by the blocking part 233. Consequently, the restriction element 25 which is rotated in the direction D3 is returned to the original position where the restriction element 25 is not rotated.

In the above embodiment, the way of allowing the restriction element 25 which is rotated in the direction D3 to be returned to the original un-rotated position according to the position of the blocking part 233 and the weight distribution of the restriction element 25 is presented herein for purpose of illustration and description only. It is noted that the way of allowing the restriction element 25 to be rotated to its original position is not restricted. Those skilled in the art will readily observe that numerous modifications and alterations may be made while retaining the teachings of the invention.

Figure 16:
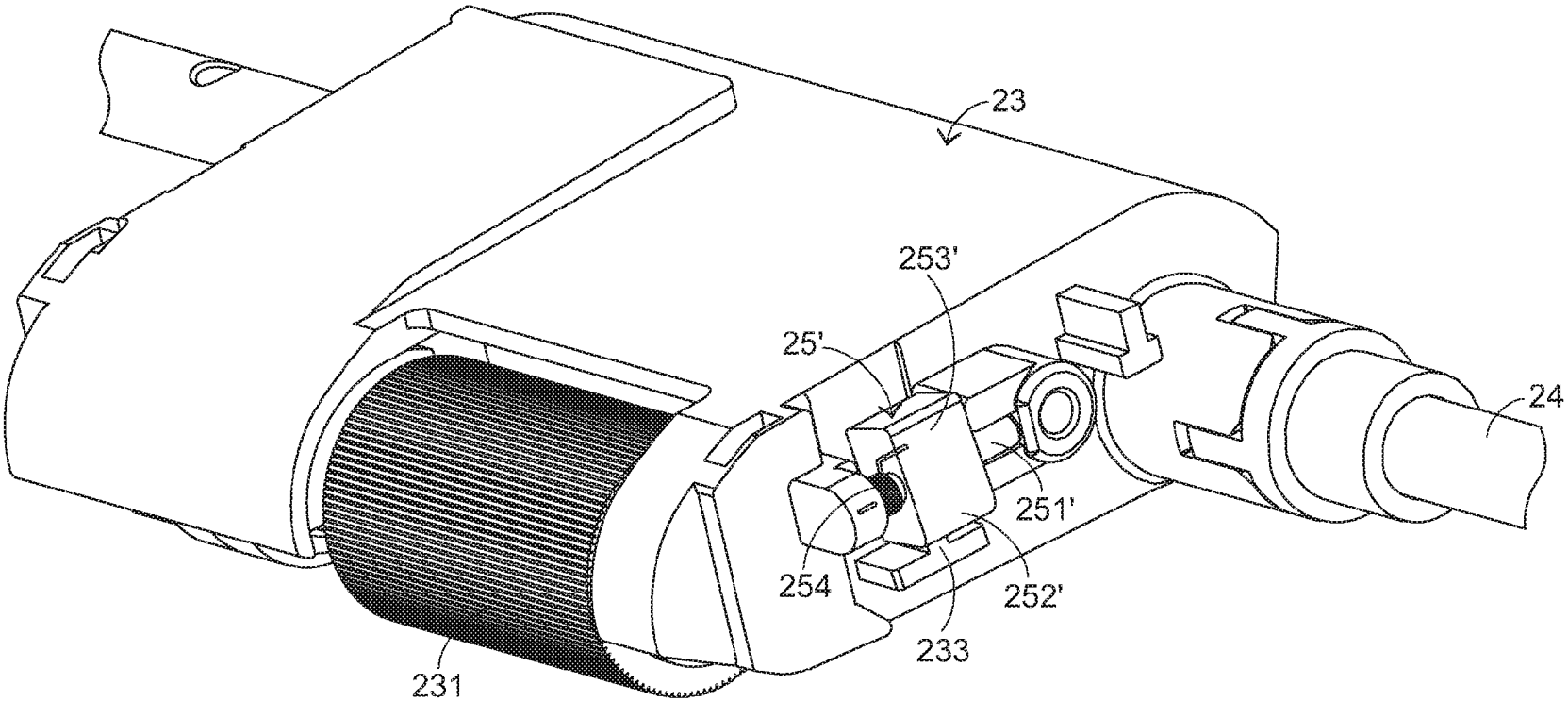
FIG. 16 is a schematic perspective view illustrating the relationship between a pick-up arm and a restriction element of an automatic document feeder according to another embodiment of the present invention.

FIG. 16 is a schematic perspective view illustrating the relationship between a pick-up arm and a restriction element of an automatic document feeder according to another embodiment of the present invention. The operating principles of the restriction element 25' are substantially identical to those of the restriction element of the above embodiment, and are not redundantly described herein. In comparison with the above embodiment, the front part 252' and the rear part 253' of the restriction element 25' of this embodiment have the same weight, and a torsion spring 254 is further sheathed around the first rotating shaft 251' of the restriction element 25'. Moreover, the two ends of the torsion spring 254 are connected with the pick-up arm 23 and the rear part 253' of the restriction element 25', respectively. Due to the torsion spring 254, the restriction element 25' can be automatically returned to its original position after the external force is eliminated.

Figure 17:
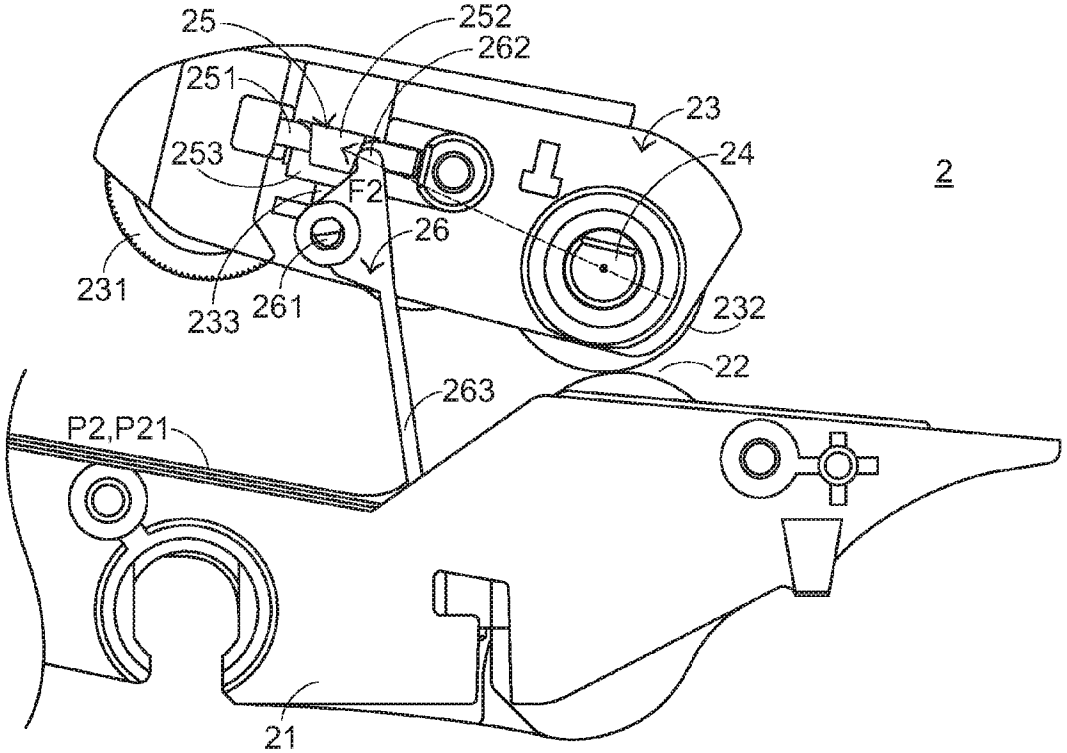
FIG. 17 is a schematic side view illustrating the automatic document feeder of FIG. 8, in which the automatic document feeder is in the idle state and the stopping part of the document stopper is excessively pushed by the document.

More especially, the relative positions between the restriction element 25, the document stopper 26 and the driving shaft 24 are determined according to the direction of a pushing force which is applied to the restriction element 25 by the document stopper 26. FIG. 17 is a schematic side view illustrating the automatic document feeder of FIG. 8, in which the automatic document feeder is in the idle state and the stopping part of the document stopper is excessively pushed by the document. Since the stopping part 263 of the document stopper 26 is excessively pushed by the front end of the document P21, the sustaining part 262 of the document stopper 26 is contacted with the lateral surface 2521 of the front part 252 of the restriction element 25. Meanwhile, a pushing force F2 is applied to the region between the sustaining part 262 of the document stopper 26 and the lateral surface 2521 of the front part 252 of the restriction element 25. As shown in FIG. 17, the relative positions between the restriction element 25, the document stopper 26 and the driving shaft 24 are elaborately designed such that a vertical distance between the extension direction of the pushing force F2 and the axel center of the driving shaft 24 is zero. That is, an extension line of the direction of the pushing force F2 intersects the axel center of the driving shaft 24. Consequently, the magnitude of the torque for the force F2 to rotate the driving shaft 24 is equal to zero. Under this circumstance, for switching the operating state of the automatic document feeder 2 from the idle state to the working state, it is not necessary for the driving shaft 24 to surmount the drag force, which is generated when the stopping part 263 of the document stopper 26 is excessively pushed by the front end of the document P21. In other words, the pick-up arm 23 can be directly driven to be moved from the first position Y1 to the second position Y2.

From the above descriptions, the automatic document feeder 2 is designed to pivotally couple the restriction element 25 to the pick-up arm 23, so that the restriction element 25 is rotatable relative to the pick-up arm 23. As previously described in the prior art, during the pick-up arm 13 of the conventional automatic document feeder 1 is ascended from the second position X2 to the first position X1, if the document P11 is stayed at a position higher than its original position X4 where the automatic document feeder 1 is in the idle state, the movement of the pick-up arm 13 is hindered. According to the present invention, since the first rotating shaft 251 of the restriction element 25 and the second rotating shaft 261 of the document stopper 26 are staggered (i.e. in the non-parallel configuration), the above problems of the conventional automatic document feeder 1 will be overcome. Moreover, as previously described in the prior art, during the pick-up arm 13 of the conventional automatic document feeder 1 is descended from the first position X1 to the second position X2, if the conventional automatic document feeder 1 is in the idle state and the stopping part 163 of the document stopper 16 is excessively pushed by the front end of the document P11, the movement of the pick-up arm 13 is also hindered. Since the relative positions between the restriction element 25, the document stopper 26 and the driving shaft 24 of the automatic document feeder 2 of the present invention are elaborately designed, the above problems of the conventional automatic document feeder 1 will be overcome. In other words, the industrial value of the automatic document feeder of the present invention is largely enhanced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An automatic document feeder, comprising:

an upper cover;

a transfer channel;

a pick-up arm located near an entrance of said transfer channel, and reciprocally movable between a first position and a second position;

a restriction element comprising a first rotating shaft, wherein said first rotating shaft is pivotally coupled to said pick-up arm; and a document stopper comprising a second rotating shaft, wherein said second rotating shaft is pivotally coupled to said upper cover, and said second rotating shaft is not in parallel with said first rotating shaft, wherein when said pick-up arm is located at said first position, said restriction element is contacted with said document stopper, so that a swinging action of said document stopper is limited by said restriction element, wherein when said pick-up arm is located at said second position, said restriction element is separated from said document stopper, so that said document stopper is permitted to be freely swung.

2. The automatic document feeder according to claim 1, wherein said first rotating shaft is disposed on a sidewall of said pick-up arm.

3. The automatic document feeder according to claim 2, wherein said restriction element further comprises a front part to be contacted with said document stopper and a rear part, wherein said first rotating shaft is penetrated through a region between said front part and said rear part, wherein said pick-up arm further comprises a blocking part, and said blocking part is disposed on said sidewall of said pick-up arm for limiting a rotatable range of said rear part of said restriction element, wherein a weight of said rear part is larger than said front part.

4. The automatic document feeder according to claim 2, wherein said restriction element further comprises a torsion spring, and said torsion spring is sheathed around said first rotating shaft.

5. The automatic document feeder according to claim 1, wherein said document stopper further comprises a sustaining part and a stopping part, wherein when said pick-up arm is located at said first position, said sustaining part is contacted with said restriction element, and a document is stopped by said stopping part from being introduced into said transfer channel.

6. The automatic document feeder according to claim 1, further comprising a driving shaft, wherein said driving shaft is penetrated through said pick-up arm, and pivotally coupled to said upper cover.

7. The automatic document feeder according to claim 6, wherein the relative positions between said restriction element, said document stopper and said driving shaft are determined according to a direction of a pushing force which is applied to said restriction element by said document stopper, wherein an extension line of said direction of said pushing force which is applied to said restriction element by said document stopper intersects an axel center of said driving shaft.

8. The automatic document feeder according to claim 1, wherein said pick-up arm comprises:

a pick-up roller for feeding a first document of plural documents into said transfer channel; and a separation roller for separating said first document from a second document underlying said first document, so that only said first document is allowed to be fed into said transfer channel.

9. The automatic document feeder according to claim 1, further comprising an input tray for supporting at least one document thereon.

* * * * *